US008911308B2

(12) United States Patent
Daniels

(10) Patent No.: US 8,911,308 B2
(45) Date of Patent: Dec. 16, 2014

(54) FOOTBALL QUARTERBACK TRAINING APPARATUS

(76) Inventor: Thomas Daniels, Kennesaw, GA (US)

( * ) Notice: Subject to any disclaimer, the term of this patent is extended or adjusted under 35 U.S.C. 154(b) by 155 days.

(21) Appl. No.: 13/572,375

(22) Filed: Aug. 10, 2012

(65) Prior Publication Data

US 2013/0040764 A1 Feb. 14, 2013

Related U.S. Application Data

(60) Provisional application No. 61/523,051, filed on Aug. 12, 2011.

(51) Int. Cl.
*A63B 69/00* (2006.01)
*A63B 69/34* (2006.01)

(52) U.S. Cl.
CPC ..... *A63B 69/00* (2013.01); *A63B 69/002* (2013.01); *A63B 69/345* (2013.01)
USPC ..... 473/439; 473/422

(58) Field of Classification Search
CPC ..... A63B 69/002; A63B 63/00; A63B 2242/007; A63B 63/06; A63B 69/345; A63B 2243/0025
USPC ..... 473/422, 438, 439, 444, 470, 251
See application file for complete search history.

(56) References Cited

U.S. PATENT DOCUMENTS

| | | | | | |
|---|---|---|---|---|---|
| 3,398,954 | A * | 8/1968 | Nedwick | 473/438 |
| 3,534,958 | A * | 10/1970 | Lipscomb | 473/439 |
| 3,573,867 | A * | 4/1971 | Mehrens | 473/439 |
| 3,680,862 | A * | 8/1972 | Russell et al. | 473/439 |
| 3,810,618 | A * | 5/1974 | Nedwick | 473/439 |
| 3,823,939 | A * | 7/1974 | Bottorff | 473/439 |
| 4,029,315 | A * | 6/1977 | Bon | 473/439 |
| 4,534,557 | A * | 8/1985 | Bigelow et al. | 473/442 |
| 4,751,642 | A * | 6/1988 | Silva et al. | 473/152 |
| 4,869,503 | A * | 9/1989 | Grasso | 473/444 |
| 4,934,938 | A * | 6/1990 | Orlandi et al. | 473/444 |
| 4,936,578 | A * | 6/1990 | Hudson, Sr. | 473/439 |
| 4,998,727 | A * | 3/1991 | Person | 473/438 |
| 5,252,076 | A * | 10/1993 | Kelleher | 473/438 |
| 5,688,196 | A * | 11/1997 | O'Neil | 473/439 |
| 5,882,204 | A * | 3/1999 | Iannazo et al. | 434/251 |
| 6,866,595 | B1 * | 3/2005 | Elder et al. | 473/446 |
| 7,131,917 | B2 * | 11/2006 | Spencer | 473/444 |
| 7,951,045 | B1 * | 5/2011 | Brader | 434/251 |
| 8,167,743 | B1 * | 5/2012 | Kangas et al. | 473/441 |
| 2007/0099730 | A1 * | 5/2007 | Driver | 473/422 |
| 2013/0040764 | A1 * | 2/2013 | Daniels | 473/439 |

FOREIGN PATENT DOCUMENTS

| | | | | |
|---|---|---|---|---|
| FR | 2582529 | A1 * | 12/1986 | A63B 69/34 |

* cited by examiner

*Primary Examiner* — Mitra Aryanpour

(57) ABSTRACT

The present invention is an apparatus for training a quarterback in skills necessary for the game of American football. The invention comprises a snap deck, targets, and blitz sticks, which all stand freely. The snap deck is a station that allows the user to create or modify play sequences, which are defined by selecting certain targets and blitz sticks to illuminate at certain times. The interface also includes displays showing session statistics. A play is initiated by removing the football from a holder on the snap deck. The targets illuminate according to the programmed play, representing open receivers, to which the user attempts to complete a pass. The blitz sticks illuminate according to the programmed play, signaling a blitz to the user, who reacts accordingly while attempting to complete a pass. If a successful pass is not completed within the time limit, all targets illuminate red and an alarm sounds.

10 Claims, 18 Drawing Sheets

FOOTBALL QUARTERBACK TRAINING APPARATUS

The current application claims a priority to the U.S. Provisional Patent application Ser. No. 61/523,051 filed on Aug. 12, 2011.

FIELD OF THE PRESENT INVENTION

The present invention relates generally to an apparatus for a training system. More specifically, the apparatus is a training system to help quarterbacks improve their football skills.

BACKGROUND OF THE PRESENT INVENTION

Play is defined as an activity undertaken by an individual driven by intrinsic motivation, or an interest or enjoyment in the activity, associated with recreational pleasure. According to Johan Huizinga, one of the founders of modern cultural history, play is "a free activity standing outside 'ordinary life' as being 'not serious' but at the same time absorbing the player intensely and utterly. It is an activity connected with no material interest, and no profit can be gained by it. It proceeds within its own proper boundaries of time and space according to fixed rules and in an orderly manner." Of course, that is not a hard and fast definition; play can take many different forms and incorporate a wide variety of rules, including none at all. It can also be an indirectly profitable activity, in the case of some organized sports games. Some psychologists argue that play is not a means to an end, but an end itself. Play is an integral part of human and animal life, and psychologists believe it serves important functions such as socialization, learning about physical environments and testing limits for future survival, and in general, exercise for the mind and body.

A game is generally defined as structured playing, usually designed for the enjoyment of the player and generally incorporating goals, rules, challenge, interaction, and stimulation of the mind, body, or both. Games in one form or another have existed for essentially the entirety of human history, and even animals have been observed playing crude games. An enormous variety of games exist today, from card games to board games to computer games to mind games to ball games.

Sports, which often take the form of a game of some sort, are forms of competitive physical activity, typically involving opposing or otherwise competing teams which aim to win a game or otherwise accomplish a certain goal before the other team or teams. Sports aim to use, maintain or improve physical fitness and provide entertainment to participants and may be participated in casually or officially with a league or other organization. Sports have been around for many centuries, with archeological evidence to suggest that the Chinese engaged in sporting activities as early as 2000 BC. Evidence of early Egyptian regulated sports exists, including swimming, fishing, javelin throwing, high jumping and wrestling. Many hundreds of different sports exist today, from those requiring only two participants, to those with hundreds of simultaneous participants.

Sports are generally recognized as activities which are based in physical athleticism or dexterity, although some sports associations recognize a few non-physical sports. The definition of a sport that is closest to an international agreement of a definition has been put forth by SportAccord, the association for the largest international sports organizations, saying that a sport should have an element of competition, be in no way harmful to any living creature, not rely on equipment provided by a single supplier, and not rely on any "luck" element specifically designed into the sport. They also say that a sport may involve primarily physical, mental, motorized, co-ordination, or animal supported elements. In the United States and in many other places, the most popular sports in general are American football, baseball, basketball, and ice hockey, in addition to other popular sports such as soccer, lacrosse, and rugby. Football has the highest participation of any sport at the high school and college levels in the United States.

Training is the acquisition of knowledge, skills, and competencies as a result of the teaching of vocational or practical skills and knowledge that relate to specific useful competencies. In other words, training is the process of intentionally improving one's capability, capacity and performance. Training is required for many roles in life, especially in the labor market, where many jobs require specific skills which are important for the employee to properly perform their duties. Training is often required to promote safety in hazardous environments. Physical training concentrates on mechanistic goals, such as developing physical skills or muscles, and is a large part of serious or professional sports participation. Since sports are essentially a measure of which team is better or more proficient at certain tasks or skills such as teamwork, traversing distance, accuracy with a projectile or other similar skills, it is necessary for a team which desires to achieve victory to train their team members diligently in the necessary skills. This is generally accomplished by scheduled practice sessions usually involving the entire team or a large portion of it.

The quarterback position is particularly important in the game of football. The quarterback is the leader of the team on the field as he is the one who starts each play with the ball and makes the decision of how to advance the ball down the field. The quarterback position requires a number of skills that are difficult to develop. The quarterback must learn to quickly find an open receiver and get the ball to the receiver before a blitz or pass rush reaches the quarterback. When a receiver is not open, the quarterback must learn to quickly locate another receiver and quickly get rid of the football. An important aspect of football practice is to develop ball handling proficiency on the part of the quarterback in acquiring skill in passing. Important parts of both ball handling and passing on the part of the quarterback are accuracy, as well as the speed with which the quarterback releases the ball. In addition, a quarterback must be skilled in recognizing a blitz or pass rush and be able to mitigate the risk those situations present. Unfortunately, it is difficult for quarterbacks to hone timing and decision making skills without working with the entire football team. It is therefore difficult for the quarterback to practice and improve his skills on his own.

Various devices have been developed previously for the purpose of enhancing football training or enabling a player to practice his skills on his own. For example, one prior art discloses a mechanical training device to be used by quarterbacks in practicing reception of the ball at the start of play and passing of the ball to a receiver. This device simulates the delivery of the ball from the center to the quarterback of a football team, in addition to simulating the delivery of the ball from the quarterback to a receiver of a football team. In another prior art, a machine is disclosed for simulating the snap of the ball from the center to the quarterback. In addition, one or more timers and alarms are provided which time and signal the lapse of time allotted in which the quarterback must execute a play. Another prior art discloses apparatus for practicing punting, passing, or kicking of the football. This device is primarily for use in measuring azimuth angle, equivalent distance and angle of elevation of a ball that is punted, passed or kicked. While these devices aid in the practice of certain aspects of a football game, they are limited in function. There appears to be few, if any, apparatus suitable for timing and scoring in addition to aiding with training for passing and blitz or pass rush mitigation.

It is therefore an object of the present invention to provide an apparatus to improve a quarterback's skills. In particular, the present invention improves the quarterback's peripheral vision, target recognition, release time, reaction time, accuracy, footwork, and muscle memory. It is a further object of the present invention to create a realistic game situation without needing an entire team of football players.

DETAIL DESCRIPTIONS OF THE PRESENT INVENTION

All illustrations of the drawings are for the purpose of describing selected versions of the present invention and are not intended to limit the scope of the present invention.

Figure 1:
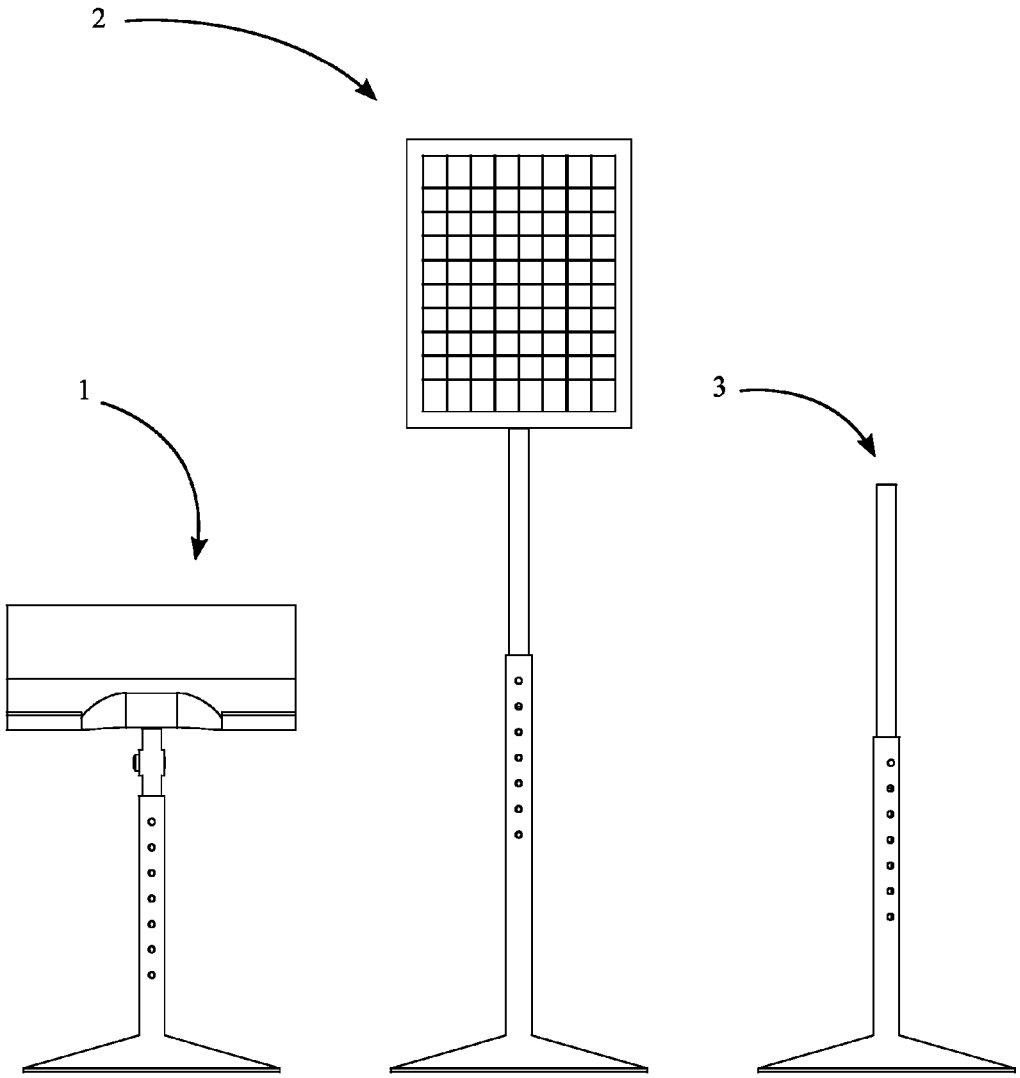
FIG. 1 is a front view of the three primary components of the present invention.
Figure 2:
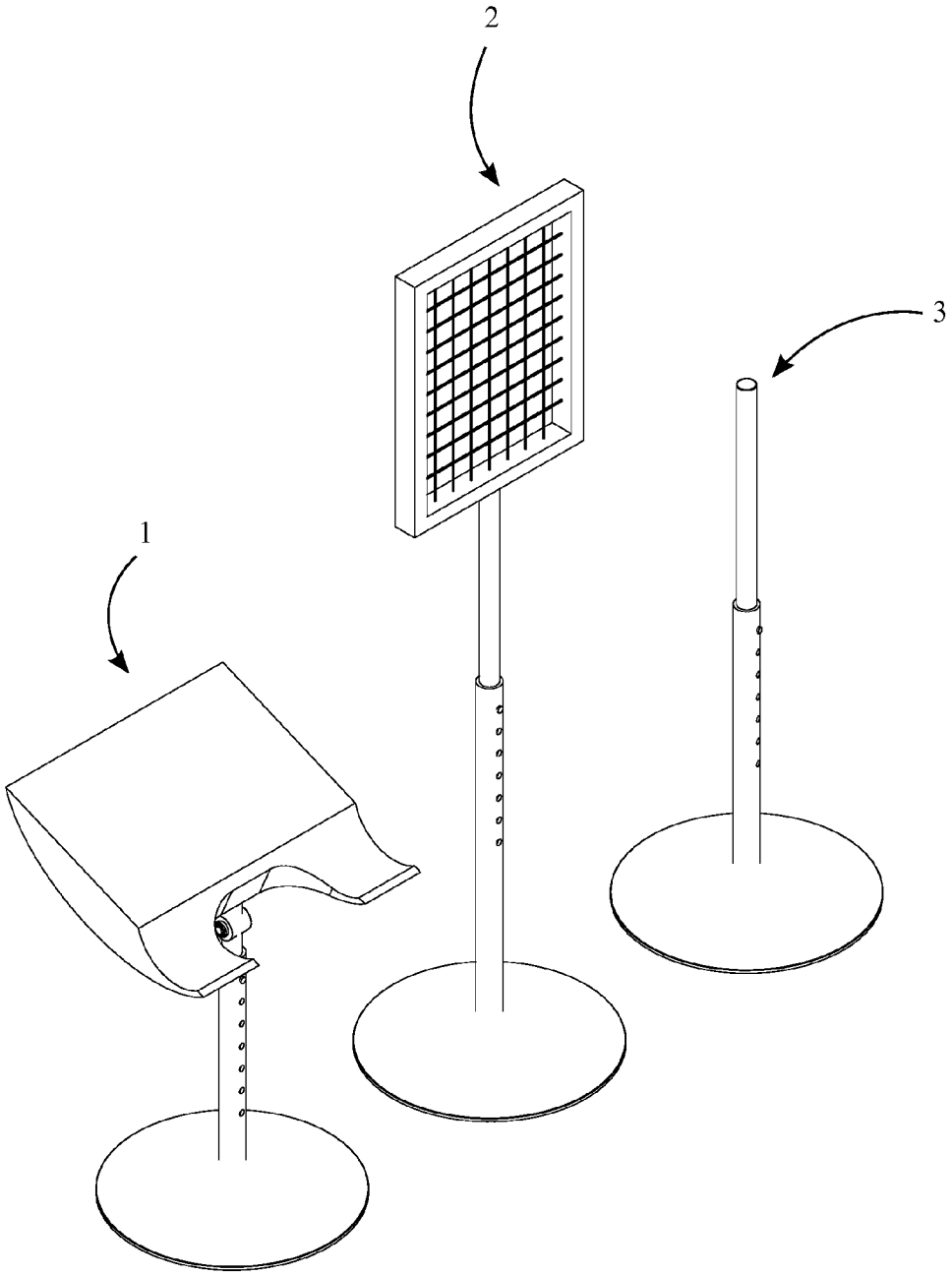
FIG. 2 is a perspective view of the three primary components of the present invention.
Figure 3:
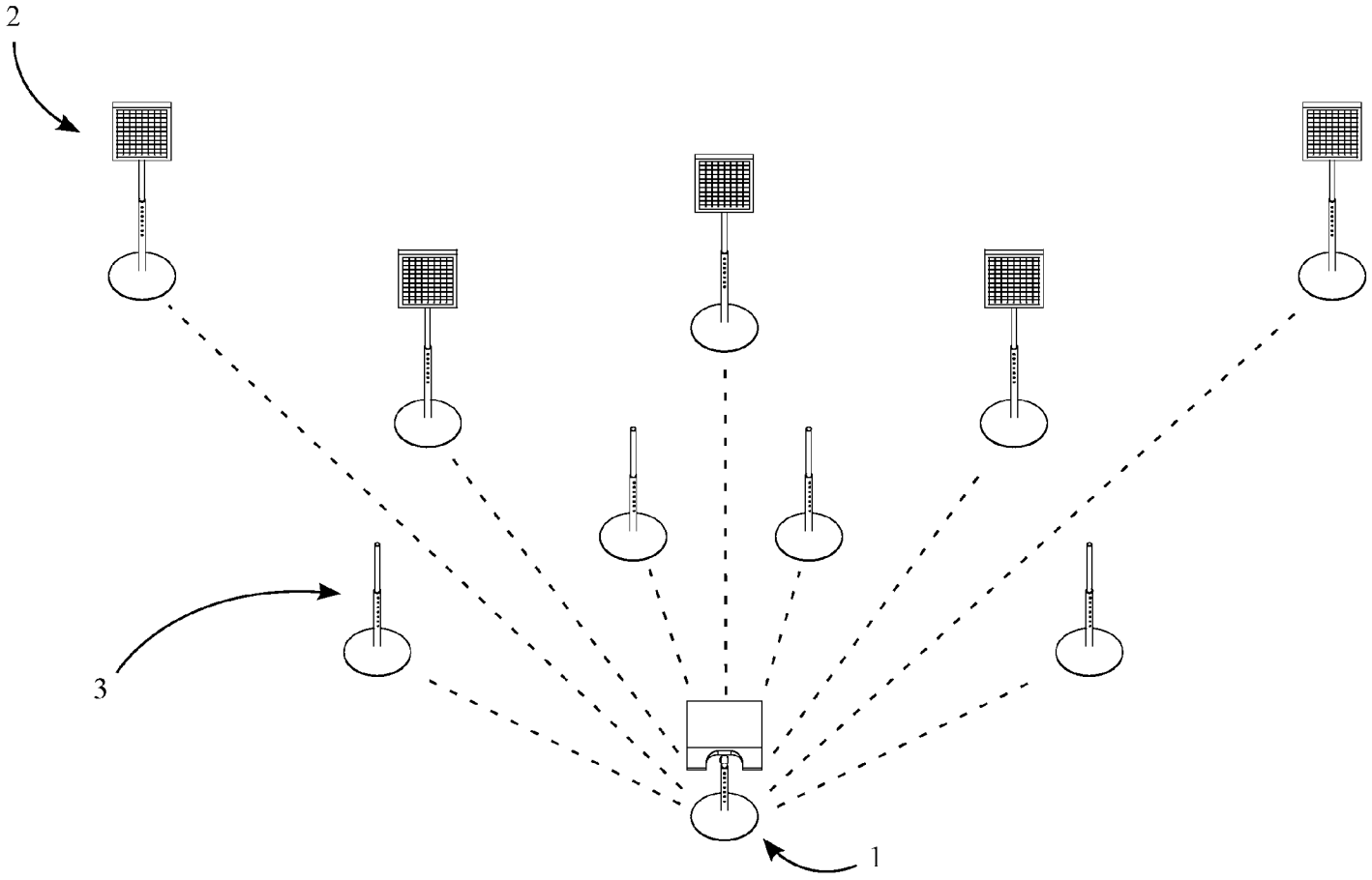
FIG. 3 is a diagram illustrating the general arrangement of the primary components of the present invention and the radio communications between the snap deck and the targets and blitz sticks.

The present invention is a training system for the position of quarterback in the game of American football. Referring to FIGS. 1-3, the present invention generally comprises a snap deck 1, a plurality of targets 2, and a plurality of blitz sticks 3. The snap deck 1 is the control and communication hub for the present invention, the targets 2 are free-standing objects that illuminate to signal the user to throw a football into a designated area, and the blitz sticks 3 are free-standing objects placed between the snap deck 1 and the targets 2 that illuminate to signal to the user to react accordingly to an imaginary blitz or pass rush.

Figure 4:
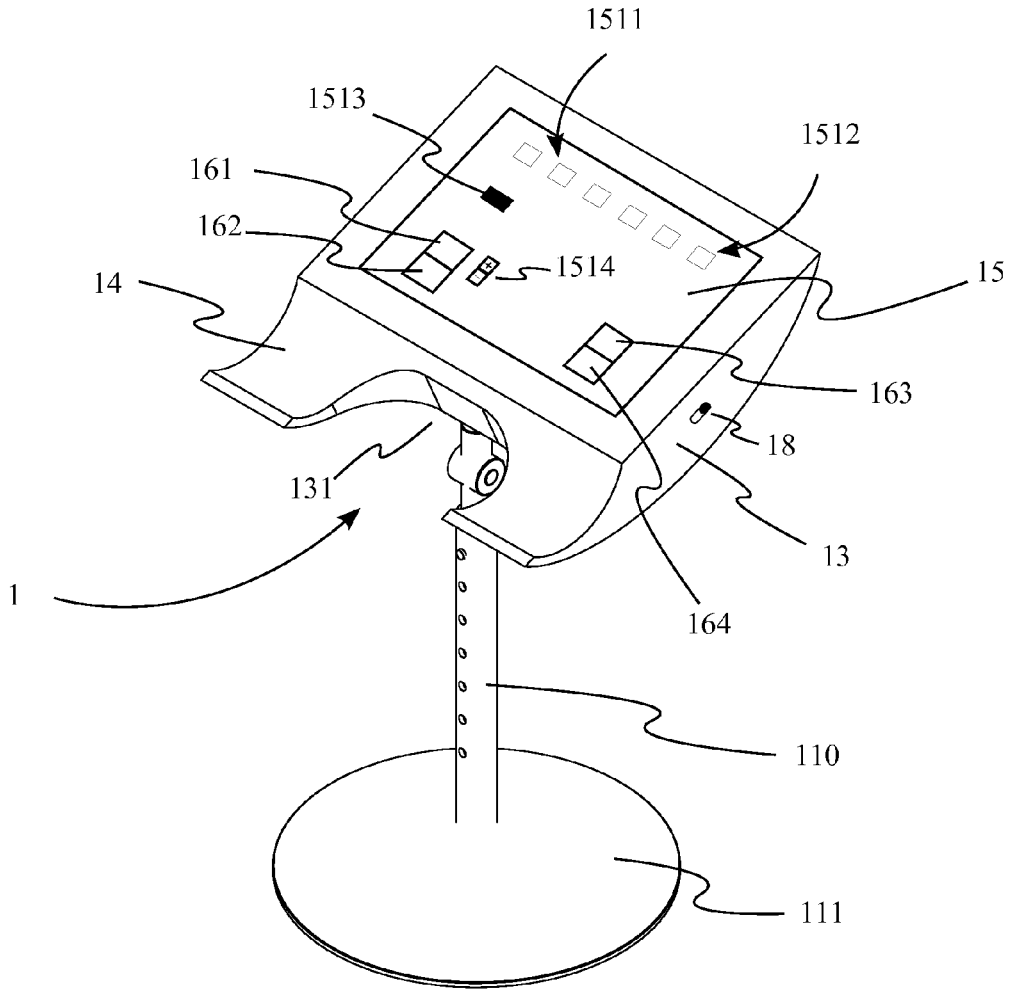
FIG. 4 is a perspective view of the snap deck.
Figure 5:
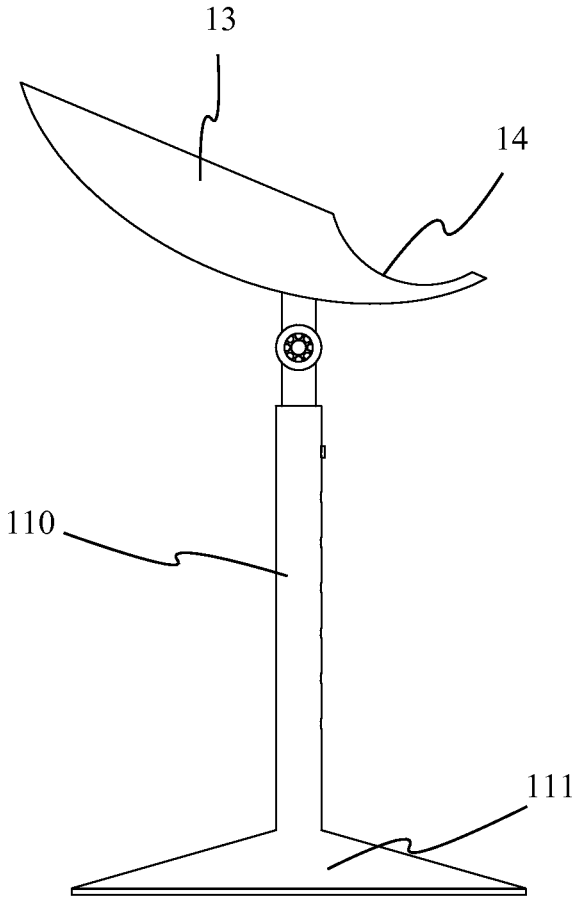
FIG. 5 is a side view of the snap deck.

Referring to FIGS. 4-5, the snap deck 1 is a free standing control hub comprising a deck radio communication device 11, a deck chipset, a housing 13, a football holder 14, a football holder 14 sensor 141, a control panel 15, a plurality of buttons 151, a plurality of numerical displays 16, a speaker 17, an on/off switch 18, a deck power source 19, an adjustable height deck leg 110, and a deck base 111.

In the preferred embodiment of the present invention, the deck radio communication device 11 comprises an apparatus that sends and receives electromagnetic waves in the radio frequency band in order to facilitate two-way electrical communicative coupling between the snap deck 1 and the plurality of targets 2 and the plurality of blitz sticks 3. The deck radio communication device 11 operates utilizing previously known methods of radio communication. The deck radio communication device 11 is controlled by the deck chipset 12 and is powered by the deck power source 19. In the preferred embodiment of the present invention, the deck radio communication device 11 is positioned within the snap deck housing 13. In the preferred embodiment of the present invention, when the snap deck 1 is turned on, the deck radio communication device 11 sends a signal to the target radio communication devices 23 and the blitz stick radio communication devices 32 to signal them to turn on as well.

Figure 16:
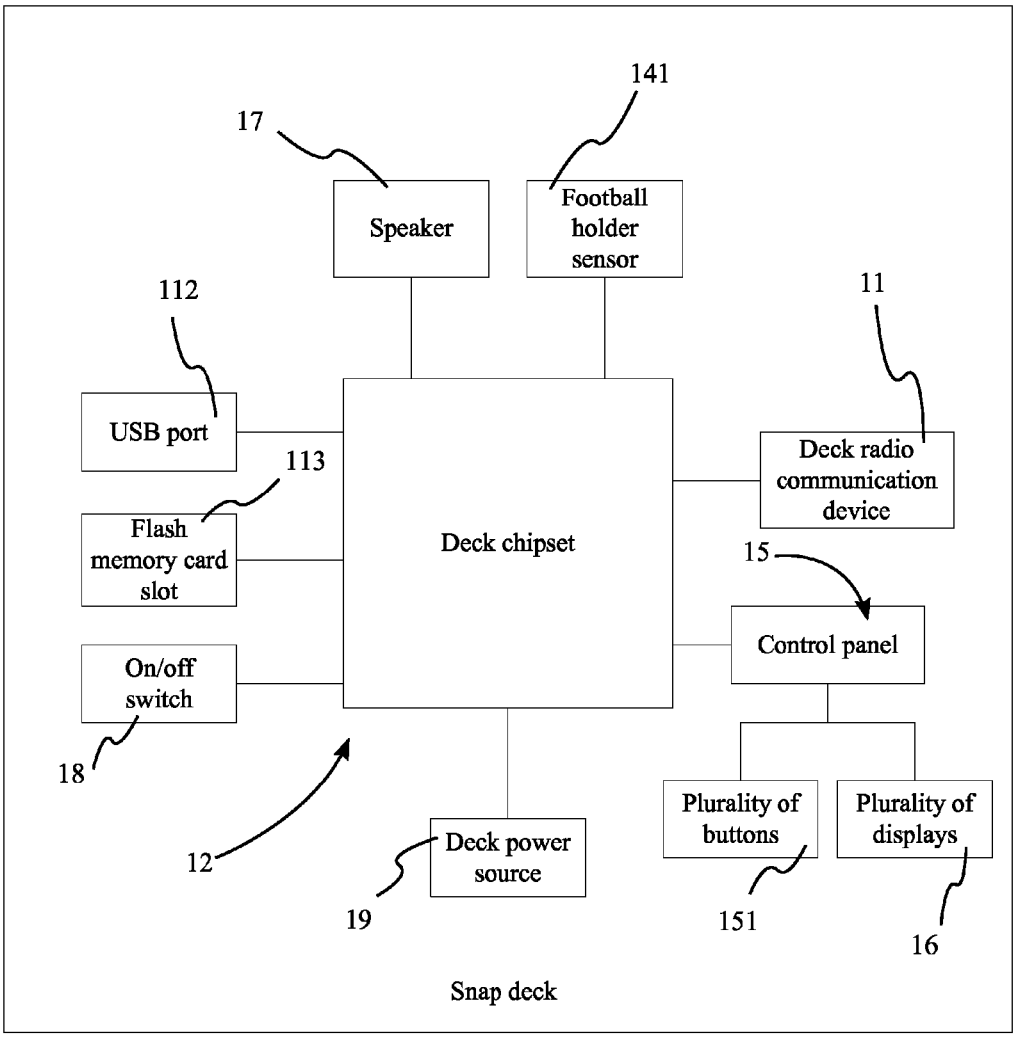
FIG. 16 is a schematic diagram showing the electronic components of the snap deck.

Referring to FIG. 16, the snap deck 1 chipset is a component or combination of components of the electronic variety such as, but not limited to, circuit boards, wires, and processors necessary to facilitate the translation of user input into desired effects in the operation of the system. The snap deck chipset 12 receives electrical inputs from various components of the system, such as, but not limited to, the control panel 15, deck radio communication device 11, and football holder sensor 141, processes the inputs, and produces the appropriate outputs, such as, but not limited to, calculations for operating the timer countdown or the other numerical displays 16, signals to activate the speaker 17, signals to the deck radio communication device 11 to communicate the appropriate commands to the targets 2 and blitz sticks 3, and the calculations necessary for determining the timing of the signals. The snap deck 1 chipset receives power from the deck power source 19. In the preferred embodiment of the present invention, the snap deck 1 chipset is located within the adjustable height deck leg 110. In alternate embodiments, the deck chipset 12 may be located within the snap deck 1 base or in another location. In the preferred embodiment of the present invention, the snap deck 1 chipset also comprises interfaces with digital media storage devices, such as, but not limited to, one or more universal serial bus (USB) ports 112 and a flash memory card slot 113 so that users can create custom plays on the computer and transfer them to the snap deck 1 using the digital media storage device slots 112 and 113.

Referring to FIGS. 4-5, in the preferred embodiment of the present invention, the snap deck housing 13 is roughly rectangular on its top face and the bottom face is mildly curved so that the side view of the housing 13 resembles half of an ellipse. The housing 13 is preferably made of durable plastic or another appropriate material. The front lateral side 131 of the housing 13 closest to the user has a shelf, or football holder 14, resembling a trough for holding a football of most official sizes. The football holder 14 incorporates a sensor for detecting the presence of the football. In one embodiment of the present invention, the football holder sensor 141 is a pressure sensor. In the preferred embodiment of the present invention, the football holder sensor 141 is of the light dependent photoresistor variety, utilizing ambient light levels to detect the presence of the football. Resistance increases as light levels increase, providing a signal to indicate the presence of light hitting the sensor. When the football is in the football holder 14, the football blocks light from entering the football holder sensor 141 and the resistance is low. After the football is removed from the holder, the resistance of the sensor is higher. The deck chipset 12 detects this difference in resistance in order to realize the removal of the football from the football holder 14. In another embodiment, the football holder sensor 141 comprises a mechanical switch that engages or disengages an electrical connection when depressed in order to signal the presence of the football.

Referring to FIG. 4, in the preferred embodiment of the present invention, the snap deck 1 also comprises a control panel 15 with a plurality of buttons 151. The control panel 15 is positioned on the top face of the housing 13. In the preferred embodiment of the present invention, the control panel 15 comprises a touch screen interface, allowing the present invention to facilitate a customizable layout for the control panel 15. In the preferred embodiment of the present invention, the control panel 15 comprises a plurality of buttons 151, including, but not limited to, target buttons 1511, blitz stick buttons 1512, a set button 1513, and timer adjustment buttons 1514. The buttons may be physical buttons or, preferably, the control panel 15 may comprise an electronic visual display or touch screen that can detect the presence and location of a touch within the display area that displays the buttons. When the user presses a button, a signal associated with that button is sent to the deck chipset. In the preferred embodiment of the present invention, the buttons are positioned in a linear fashion adjacent to the rear edge of the top face of the control panel 15, away from the user.

In the preferred embodiment of the present invention, the snap deck 1 also comprises a plurality of numerical displays 16 positioned on the top face of the housing 13, including, but not limited to, a timer display 161, a point counter 162, a pass attempts counter 163, and a pass completion counter 164. The timer display 161 shows the amount of time the user has remaining to perform certain actions, particularly, but not limited to, completing a pass to a target. The point counter 162 displays a running total of points the user has accumulated over the practice session. Hereinafter, the concepts of score and points are used interchangeably. Points are given based on the number of completed pass attempts. For example, the user is given five points for every successfully completed pass. In one embodiment of the present invention, the number of points per pass is determined by the amount of time remaining on the timer countdown when the pass is detected to have been completed. In another embodiment of the present invention, points may be deducted when a pass attempt is not successfully completed. In another embodiment of the present invention, points may be deducted based on the amount of time elapsed before a successful pass is completed. The pass attempts counter 163 displays a running total of pass attempts the user has made. The pass attempts counter 164 displays a running total of the number of times the user has successfully completed a pass, which is signaled to the snap deck 1 by the target radio communication device 23, which is activated by the target chipset 24 when the target chipset 24 receives a signal from the pass detection sensors 29 on the target.

In the preferred embodiment of the present invention, the snap deck 1 also comprises a speaker 17 that is controlled by the deck chipset 12 and powered by the deck power source 19. In the preferred embodiment of the present invention, the speaker 17 is located on the back or bottom of the snap deck 1 housing 13, positioned on the housing 13 and traversing into the housing 13 so that the sound waves from the speaker 17 are not obstructed by the housing 13. The snap deck 1 also comprises an on/off switch 18, preferably on the top or side face of the housing 13. The on/off switch 18 is preferably a mechanical switch similar to a common light switch that controls the delivery of power from the snap deck 1 power source to the chipset and other components. In another embodiment of the present invention, the on/off switch 18 may be part of a digital touchscreen display, a physical press button, a slider or another type of switch.

The snap deck 1 also comprises a deck power source 19. The deck power source 19 may comprise a number of different embodiments, including, but not limited to, a rechargeable battery pack, standard batteries, and a corded power connection for a standard 125 volt, 15 amp electrical outlet or similar wall sockets. In the preferred embodiment of the present invention, the deck power source 19 is a rechargeable battery pack. In one embodiment of the present invention, the snap deck 1 may utilize a combination of different power sources. The deck power source 19 provides power to the deck radio communication device 11, the deck chipset 12, the control panel 15, the holder sensor 141, and the speaker 17.

The snap deck 1 also comprises one or more adjustable height deck legs 110 in order to vary the height of the snap deck 1. In the preferred embodiment of the present invention, the snap deck 1 is supported by a single adjustable height deck leg 110. In the preferred embodiment of the present invention, the adjustable height deck leg 110 of the snap deck 1 comprises two concentric cylindrical leg pieces utilizing a commonly known spring-loaded pin and hole mechanism. The larger, outer leg piece comprises a number of circular holes whose axes are perpendicular to the cylindrical axis of the leg piece in a linear pattern parallel to the axis of the leg piece. The smaller, inner leg piece comprises a solid, spring-loaded pin perpendicular to the cylindrical axis of the leg piece that is forced outward by the spring. In order to adjust the height of the leg, the user depresses the pin beyond the inner diameter of the outer concentric leg piece and slides the smaller leg piece vertically until the desired height is achieved, at which time the user maneuvers the pin to be concentric with the corresponding hole, allowing the spring to push the pin through the hole and securing the leg at the new height.

In an alternate embodiment of the present invention, the adjustable height deck leg 110 comprises two concentric leg pieces and a tightening mechanism that joins them. One leg piece is slightly smaller than the other, which is hollow, allowing the first leg piece to slide inside the second leg piece and to modify the height of the snap deck 1 by concentrically sliding the leg pieces relative to each other. The top of one leg piece is connected to the bottom of the snap deck 1 and the bottom of the other leg piece is connected to the top of the deck base 111. The two leg pieces are connected by a mechanism that affixes the leg pieces in place relative to each other utilizing a knob that, when turned, advances a screw, protrusion or other object, pressing against the leg piece wall and holding the leg pieces in place with friction. In another embodiment of the present invention, the connection of the upper leg piece to the bottom of the snap deck 1 comprises a similar mechanism for adjusting the angular orientation of the snap deck housing 13.

The snap deck 1 base is a short, round disk- or cone-like object to which the bottom piece of the target adjustable leg is affixed. The deck base 111 may be filled with a heavy material such as, but not limited to, water, concrete, metal or sand. In one embodiment of the present invention, the deck base 111 comes pre-filled with the heavy material. In another embodiment, the deck base 111 comprises a cavity and a hole through which the user may fill the base with a material of their choosing. In the preferred embodiment of the present invention, the target stabilizing base is round. In other embodiments, the deck base 111 may comprise different shapes, such as, but not limited to, a plus sign, a square or other polygon or another shape. In an alternate embodiment, the bottom of the deck base 111 comprises a plurality of prongs forming anchors for anchoring the pedestal in the ground against accidental movement. If desired, the present invention can be used indoors in which case suction cups for the prongs can be provided to anchor the machine to a smooth surface without defacing the surface.

Figure 6:
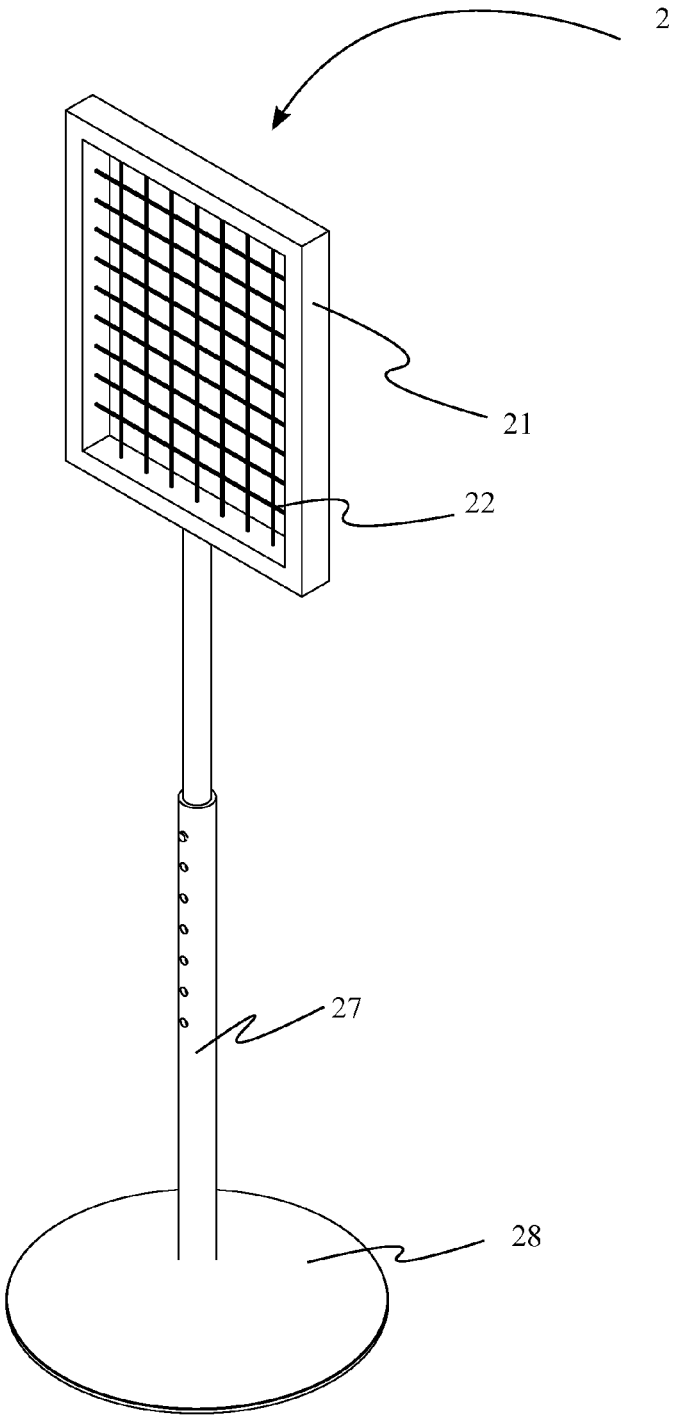
FIG. 6 is a perspective view of a target.
Figure 7:
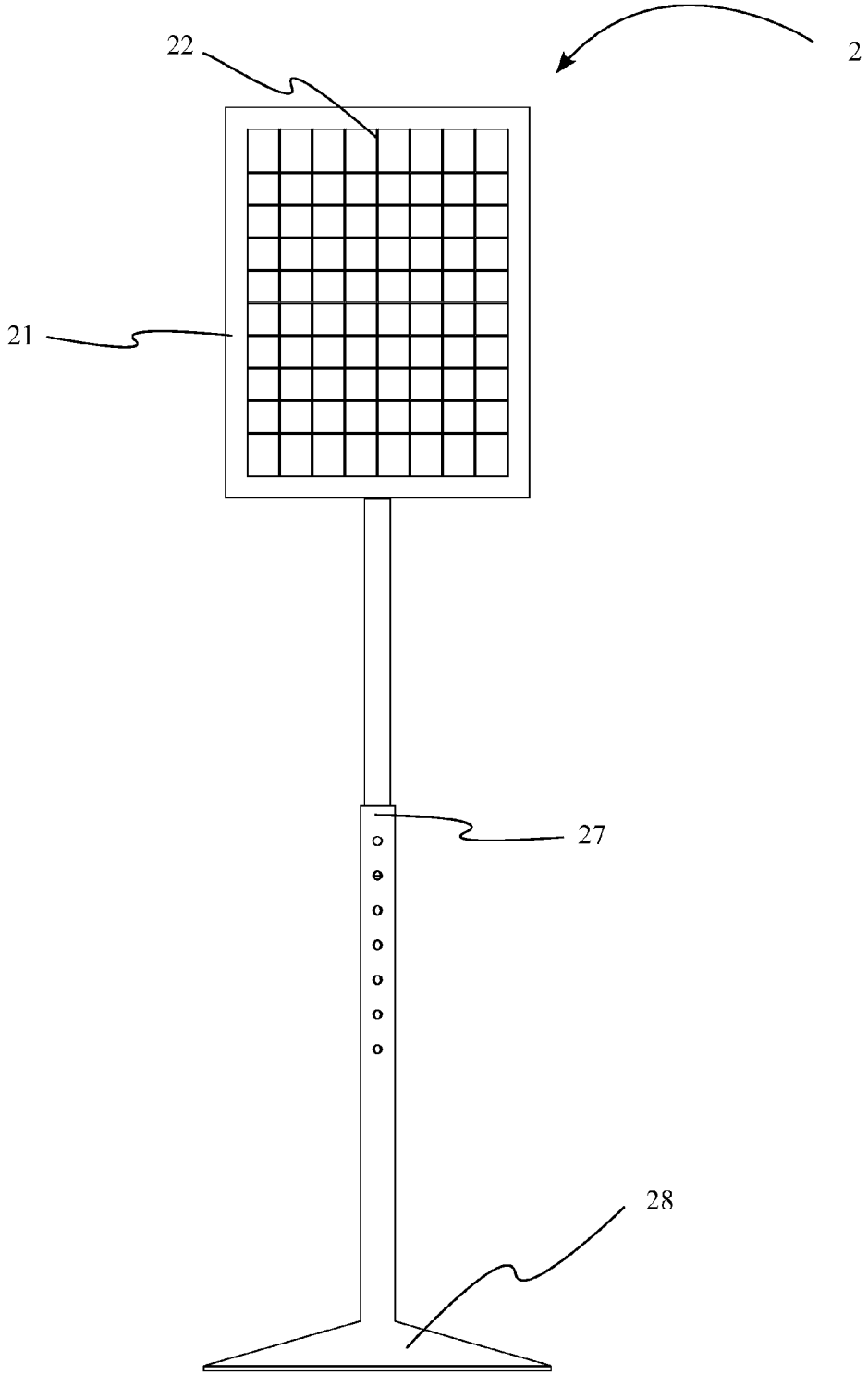
FIG. 7 is a front view of a target.

Referring to FIGS. 6-7, the targets 2 are generally comprised of a target frame 21, a net 22, a target radio communication device 23, a target chipset 24, a plurality of target lights 25, a target power source 26, an adjustable height target leg 27, a target base 28, and a plurality of pass detection sensors 29.

In the preferred embodiment of the present invention, the target frame 21 is rectangular with the left and right sides being longer than the top and bottom sides, with the left and right sides being oriented vertically. In alternative embodiments, the target frame 21 may be comprised of different shapes such as, but not limited to, a circle, a triangle, a polygon, or another shape. The target frame 21 concentrically outlines a net 22 that is attached to the inside of the target frame 21. In the preferred embodiment of the present invention, the net 22 is not taut but has sufficient slack that hangs towards the rear of the target frame 21 so that when the user completes a pass, the net 22 catches the football. The target frame 21 is the uppermost portion of the target, connected vertically above the adjustable height target leg 27, and the objective of the user is to throw the ball so that it passes inside the target frame 21 and is caught by the net 22. The target frame 21 is supported by the adjustable height target leg 27. The bottom of the adjustable height target leg 27 is connected to the target base 28. The adjustable height target leg 27 and target base 28 may be made out of any suitable material such as, but not limited to, plastic, wood, or metal. In the preferred embodiment of the present invention, the target frame 21 is made of a translucent plastic material, but may be made of another suitable material in other embodiments. The adjustable height target leg 27 comprises a plurality of target leg pieces and a mechanism for adjusting the height of the target leg in a manner similar to that described for the adjustable height deck leg 110 or utilizing another method to accomplish the goal of having an adjustable height leg.

In the preferred embodiment of the present invention, the target base 28 is a short, round disk- or cone-like object to which the bottom piece of the adjustable height target leg 27 is concentrically affixed. The target base 28 may be filled with a heavy material such as, but not limited to, water, concrete, metal or sand. In one embodiment of the present invention, the target base 28 comes pre-filled with the heavy material. In another embodiment, the target base 28 comprises a cavity and a hole through which the user may fill the base with a material of their choosing. In the preferred embodiment of the present invention, the target base 28 is round. In other embodiments, the target base 28 may comprise different shapes, such as, but not limited to, a plus sign, a square or other polygon or another shape. In one embodiment of the present invention, the target base 28 comprises a set of controls to control the electronic behavior of the target. In an alternate embodiment, the bottom of the target base 28 comprises a plurality of prongs forming anchors for anchoring the pedestal in the ground against accidental movement. If desired, the present invention can be used indoors in which case suction cups for the prongs can be provided to anchor the machine to a smooth surface without defacing the surface.

Figure 17:
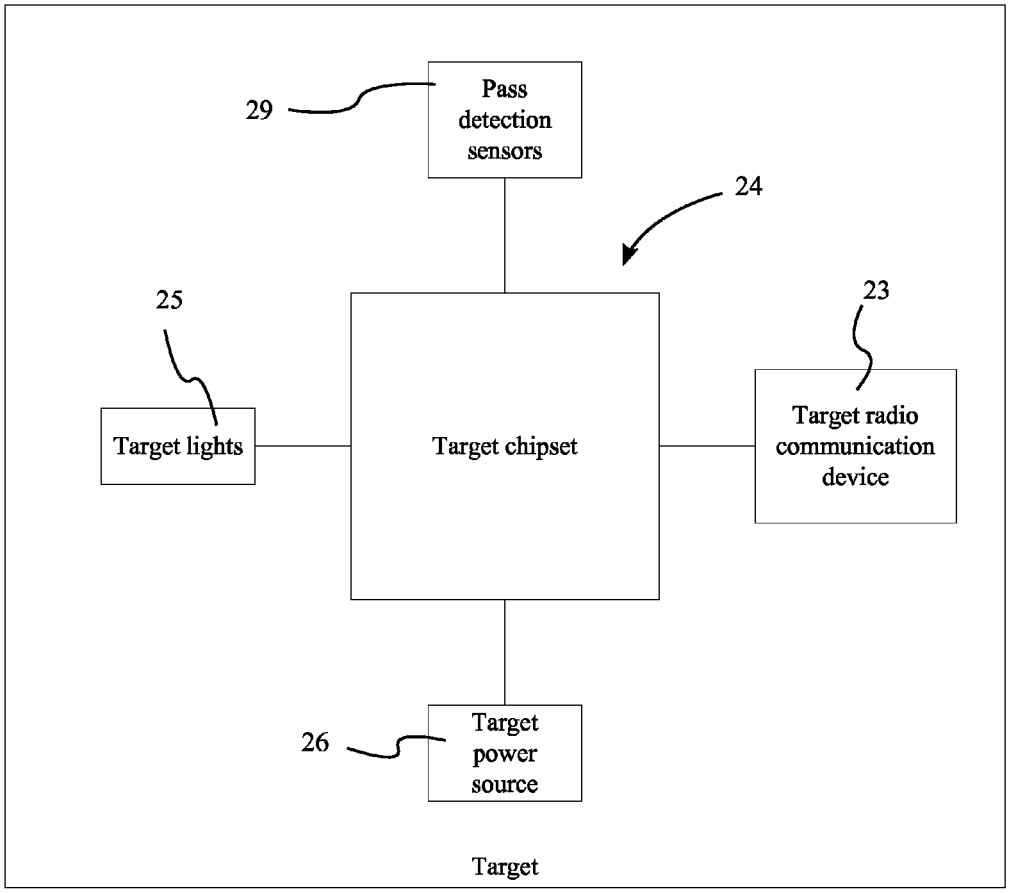
FIG. 17 is a schematic diagram showing the electronic components of each of the targets.

Referring to FIG. 17, each of the targets 2 comprises electronic components, including, but not limited to, a target radio communication device 23, a target chipset 24, a plurality of target lights 25, and a plurality of pass detection sensors 29.

In the preferred embodiment of the present invention, the target radio communication device 23 comprises an apparatus that sends and receives electromagnetic waves in the radio frequency band in order to facilitate two-way electrical communication between the target 2 and the snap deck 1. The target radio communication device 23 operates utilizing previously known methods of radio communication. The target radio communication device 23 is controlled by the target chipset 24 and is powered by the target power source 26. In the preferred embodiment of the present invention, the target radio communication device 23 is positioned within the frame, leg, or target base 28.

The target chipset 24 is a component or combination of components of the electrical variety such as, but not limited to, circuit boards, wires, and processors, necessary to facilitate the translation of received signals into desired effects in the operation of the system. The target chipset 24 receives radio input signals transmitted by the snap deck 1 through communication with the target radio communication device 23, including, but not limited to, commands to illuminate certain set of target lights 25. Upon receipt of a command via radio, the target chipset 24 processes the command and performs the appropriate action. The target chipset 24 and target lights 25 receive electrical power from the target power source 26. The target chipset 24 receives input from the target radio communication device 23 and pass detection sensors 29 and sends output to the plurality of target lights 25, in addition to communicating pass status to the snap deck 1 through the target radio communication device 23.

The target also comprises a plurality of target lights 25. In the preferred embodiment of the present invention, the target lights 25 comprise a plurality of differently colored lights in order to signify a plurality or different states, including, but not limited to, a successful pass and an unsuccessful pass. In the preferred embodiment of the present invention, the target lights 25 are positioned within the target frame 21, parallel to the side of the frame they are positioned within. In the preferred embodiment of the present invention, the targets 2 require two different sets of colored lights to indicate two different statuses, so each of the four sides of the target frame 21 houses two lights positioned parallel to each other, running the majority of the length of the side. In the preferred embodiment of the present invention, the target lights 25 are elongated and cylindrical, similar in shape to commercial fluorescent lights. In another embodiment of the present invention, the target lights 25 are positioned on the outside of the target frame 21. In the preferred embodiment of the present invention, the rear of the target frame 21 comprises one or more panels that attach to the frame utilizing snaps or screws, facilitating access to the lights inside the target frame 21 for repair or exchange.

The target also comprises a target power source 26. The target power source 26 may comprise a number of different embodiments, including, but not limited to, a rechargeable battery pack, standard batteries, and a corded power connection for a standard 125 volt, 15 amp electrical outlet or similar wall sockets. In the preferred embodiment of the present invention, the target power source 26 is a rechargeable battery pack. In another embodiment of the present invention, the target 2 may utilize a combination of different power sources.

The target also comprises a plurality of pass detection sensors 29. In the preferred embodiment, the pass detection sensors 29 are positioned within the target frame 21. The pass detection sensors 29 could be motion detection sensors such as, but not limited to, passive infrared sensors, ultrasonic sensors, or microwave sensors, accelerometers, laser sensors, sensors to detect deflections in the net 22, or other appropriate sensors. In the preferred embodiment of the present invention, the pass detection sensors 29 are of the infrared interrupter variety. A pair of sensors is positioned on opposing sides of the frame, with one sensor emitting a beam of infrared light and the other sensor receiving the light beam. When the football passes through the beam of infrared light, the beam is interrupted and the beam receptor sends a signal to the target chipset 24 indicating the state of light reception, which is processed by the target chipset 24 and communicated to the deck chipset 12 via the target radio communication device 23 and the deck radio communication device 11. The preferred embodiment of the present invention comprises a plurality of pass detection sensors 29 arranged such that a football is not able to pass through the target frame 21 without being detected.

Figure 8:
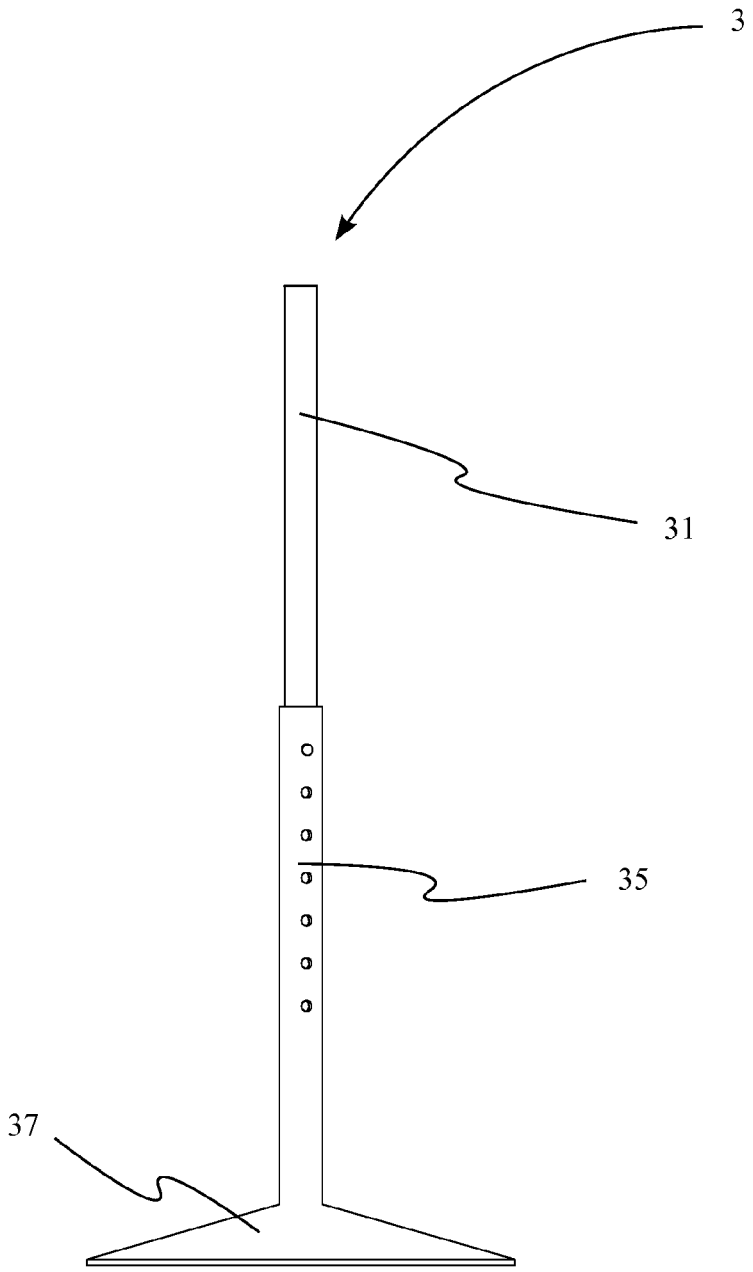
FIG. 8 is a front view of a blitz stick.
Figure 9:
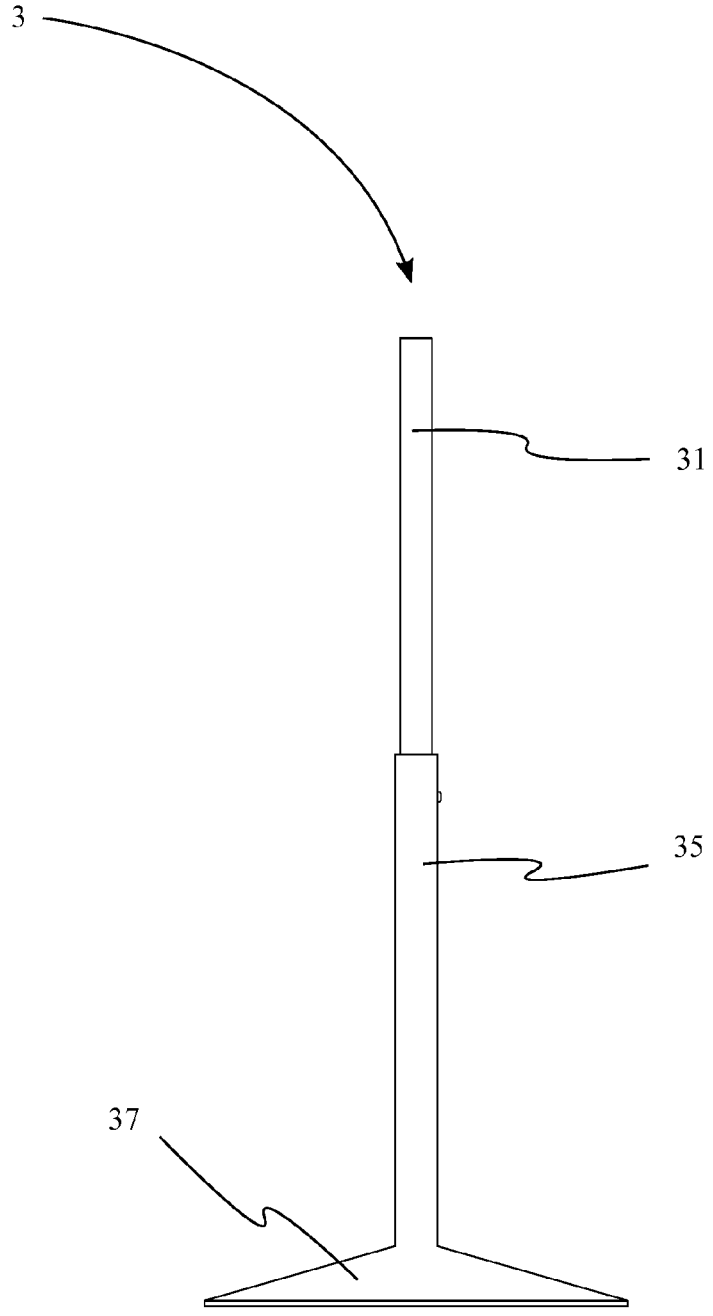
FIG. 9 is a side view of a blitz stick.

Referring to FIGS. 8-9, each of the plurality of blitz sticks 3 are comprised of a stick body 31, a stick radio communication device 32, a stick chipset 33, a stick light 34 or lights, an adjustable height stick leg 35, a stick power source 36, and a stick base 37. The blitz sticks 3 are free-standing objects similar to the targets 2, but instead of a geometrical frame holding a net, the top portion of the blitz stick comprises the stick body 31. In the preferred embodiment of the present invention, the stick body 31 is an elongated, vertical, cylindrical body. In the preferred embodiment of the present invention, the stick body 31 is plastic and translucent. In other embodiments, the stick body 31 may be another shape, orientation or material.

The bottom of the stick body 31 is attached to the top of the adjustable height stick leg 35. In one embodiment of the present invention, the stick leg is not adjustable. In another embodiment of the present invention, the stick leg is adjustable in a manner similar to that previously disclosed as comprised in the snap deck 1 and targets 2. The stick frame, stick leg, and stick base 37 may be made out of any suitable material such as, but not limited to, plastic, wood, or metal. The stick base 37 is a short, round disk- or cone-like object to which the bottom portion of the stick leg is concentrically affixed. The stick base 37 may be filled with a heavy material such as, but not limited to, water, concrete, metal or sand. In one embodiment of the present invention, the stick base 37 comes pre-filled with the heavy material. In another embodiment, the stick stabilizing base comprises a cavity and a hole through which the user may fill the base with a material of their choosing. In the preferred embodiment of the present invention, the stick base 37 is round. In other embodiments, the stick base 37 may comprise different shapes, such as, but not limited to, a plus sign, a square or other polygon or another shape. In one embodiment of the present invention, the stick base 37 comprises a set of controls to control the electronic behavior of the stick. In an alternate embodiment, the bottom of the blitz stick base 37 comprises a plurality of prongs forming anchors for anchoring the pedestal in the ground against accidental movement. If desired, the present invention can be used indoors in which case suction cups for the prongs can be provided to anchor the machine to a smooth surface without defacing the surface.

Figure 18:
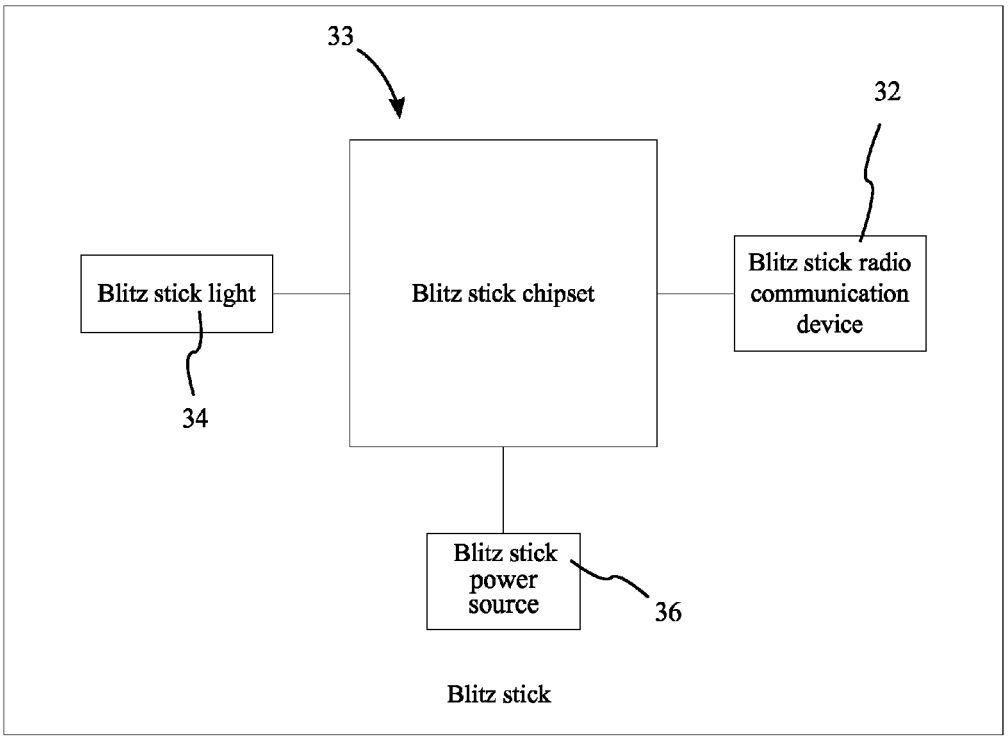
FIG. 18 is a schematic diagram showing the electronic components of each of the blitz sticks.

Referring to FIG. 18, each blitz stick 3 comprises electronic components, including, but not limited to, a stick radio communication device 32, a stick chipset 33, a stick power source 36, and a blitz stick light 34.

In the preferred embodiment of the present invention, the stick radio communication device 32 comprises an apparatus that sends and receives electromagnetic waves in the radio frequency band in order to facilitate two-way electrical communication between the blitz stick and the snap deck 1. The stick radio communication device 32 operates utilizing previously known methods of radio communication. The stick radio communication device 32 is controlled by the stick chipset 33 and is powered by the stick power source 36. In the preferred embodiment of the present invention, the stick radio communication device 32 is positioned within the body, leg, or base of the blitz stick 3.

The stick chipset 33 is a component or combination of components of the electrical variety such as, but not limited to, circuit boards, wires, and processors, necessary to facilitate the translation of received signals into desired effects in the operation of the system. The stick chipset 33 receives radio input signals transmitted by the snap deck 1 through communication with the stick radio communication device 32, including, but not limited to, commands to illuminate certain lights on the stick. Upon receipt of a radio command, the stick chipset 33 performs the appropriate action. The stick chipset 33 receives power from the stick power source 36. The stick chipset 33 receives input from the snap deck 1 radio communication device and sends output to the stick light 34.

The blitz stick 3 also comprises a stick power source 36. The stick power source 36 may comprise a number of different embodiments, including, but not limited to, a rechargeable battery pack, batteries, and a corded power connection for a standard 125 volt, 15 amp electrical outlet or similar wall sockets. In the preferred embodiment of the present invention, the stick power source 36 is a rechargeable battery pack. In the preferred embodiment of the present invention, the stick may utilize a combination of different power sources.

The blitz stick 3 also comprises at least one light. In the preferred embodiment of the present invention, the stick light 34 or lights are a single color. In an alternate embodiment of the present invention, the stick lights 34 comprise a plurality of differently colored lights in order to signify a plurality of different states.

In the preferred embodiment of the present invention, the stick light 34 is a single light bulb positioned at the top of the stick leg, pointed vertically toward to the top of the stick body 31, in a manner similar to existing toy light swords. The user may unscrew the stick body 31 at the junction between the stick body 31 and the stick leg in order to access the stick light 34 for repair or exchange. In another embodiment of the present invention, the stick light 34 is positioned within the blitz stick body 31 and is concentric with the stick body 31 and cylindrical and elongated and in a manner similar to the target lights 25. In another embodiment of the present invention, the stick light 34 is positioned on the outside of the stick body 31. In the preferred embodiment of the present invention, the snap deck 1 communicates with the blitz stick or blitz sticks 3 utilizing their respective radio communication devices in order to activate the blitz sticks 3. In the preferred embodiment of the present invention, the snap deck 1 illuminates a steady color, preferably red, to indicate a pass rush, while a pattern of flashes indicates a blitz.

In an alternative embodiment of the present invention, the targets 2 and/or blitz sticks 3 may move in order to better simulate a real football play. In one embodiment, the present invention also comprises a motorized track or plurality of tracks to which one or more targets 2 or blitz sticks 3 may be mounted to allow the targets 2 or blitz sticks 3 to move. The targets 2 or blitz sticks 3 may be directly attached to the tracks or the targets 2 or blitz sticks 3 may be mounted on a moveable platform that is attached to and actuated by the track. In the preferred embodiment, each target or blitz stick may be mounted on an independently moveable vehicle that enables the target or blitz stick to move in any direction allowed by the mechanism of the vehicle. The motion of the targets 2 and/or blitz sticks 3 is controlled by radio signals from the snap deck 1.

The overall process is executed by the snap deck 1 chipset, which acts as a control hub and interacts with each of the target chipset 24*s* and each of the blitz stick chipsets 33 in order to facilitate the completion of a number of play sequences. A play sequence is initiated by the user removing the football from the football holder 14 and terminated by a number of conditions relating to the success or failure of the user to complete a pass. A training session is defined by a number of completed play sequences. Throughout the training session, the snap deck 1 chipset accumulates statistics regarding the training session, including, but not limited to, the total number of pass attempts, the total number of successful pass completions, a current remaining play sequence time, and a current score. Throughout the training session, each statistic is continually updated and the graphical user interface of the snap deck 1 displays the continually updated training session statistics.

Figure 10:
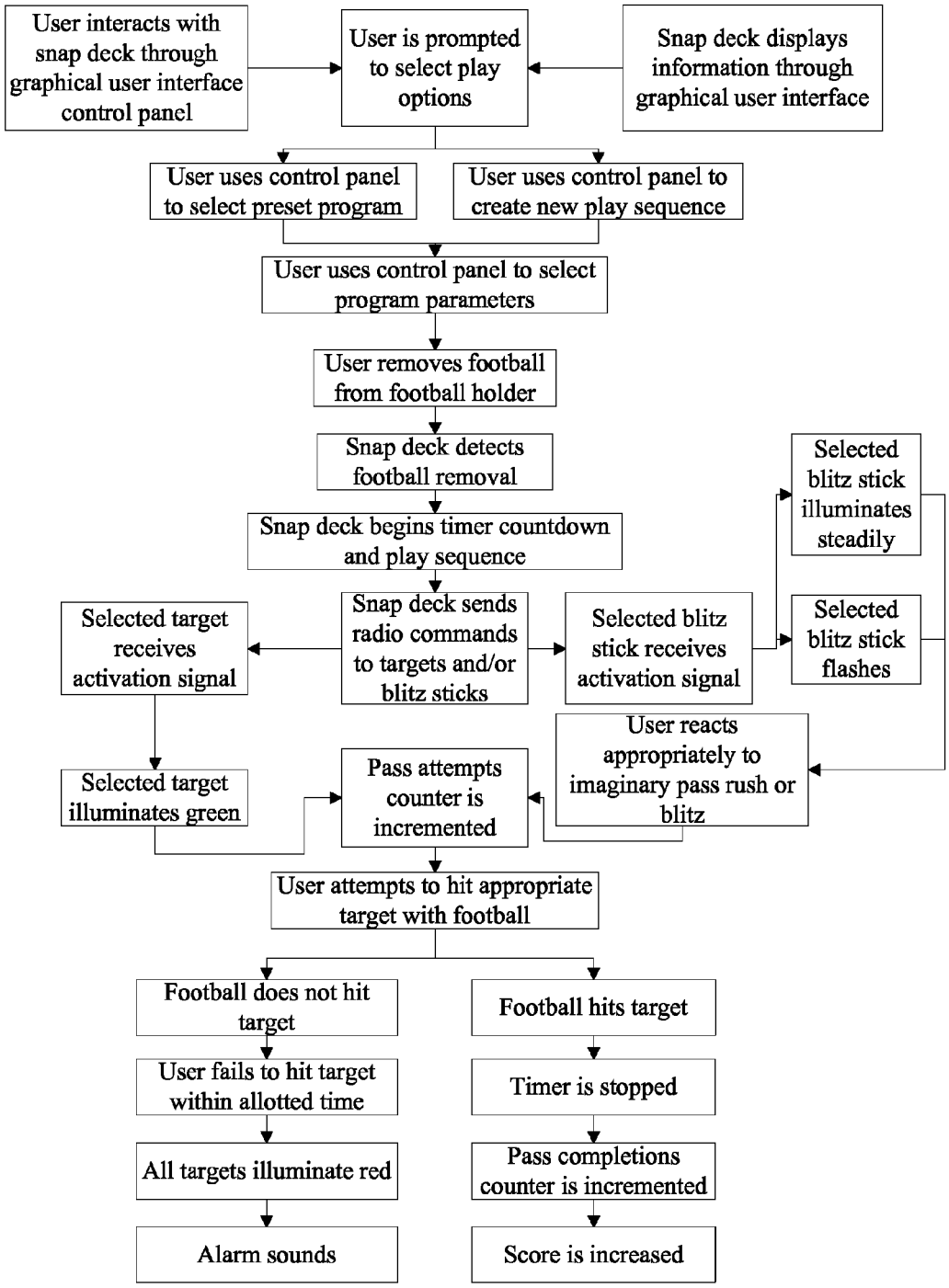
FIG. 10 is a stepwise flow diagram detailing the overall process of using the present invention.

Referring to FIG. 10, the use of the present invention is as follows. The user activates the snap deck 1 through the on/off switch 18, and is prompted by the deck chipset through the graphical user interface to utilize the buttons on the graphical user interface of the control panel 15 to program the targets 2 and blitz sticks 3. The targets 2 can be programmed to randomly light up or a user can pre-select which targets 2 to light up. The user may customize their own plays and create presets, or they may use existing preset play sequences that can be loaded from the USB port 112 or flash memory slot 113.

Figure 11:
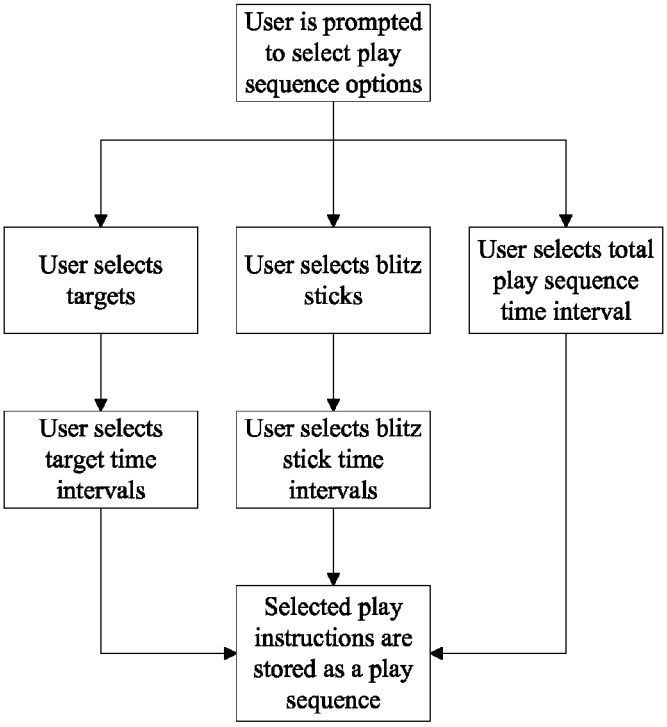
FIG. 11 is a stepwise flow diagram describing the process for creating a play sequence.

In the preferred embodiment of the present invention, the user is provided with three buttons relating to the targets 2, three relating to the blitz sticks 3, two timer adjustment buttons 1514, one for increasing a time interval and one for decreasing a time interval, and a set button 1513. Referring to FIG. 11, the user is prompted through the graphical user interface to select play options including which targets 2 and blitz sticks 3 illuminate, whether the selected targets 2 and blitz sticks 3 illuminate in sequence or simultaneously, and the time intervals determining when the targets 2 and blitz sticks 3 illuminate.

The user is prompted to select a plurality of play options through the graphical user interface in order to create a set of play instructions to facilitate a play sequence. To select only one target or blitz stick to light up, the user presses the button associated with that target or blitz stick and then presses the set button 1513. For example, to select the first target or blitz stick, the user presses the first target or blitz stick button. If there are more targets 2 or blitz sticks 3 than target or blitz stick programming buttons, the user presses a combination of buttons. For example, to select a fifth target or blitz stick, the user presses both the second and third buttons and then presses the set button 1513.

Figure 14:
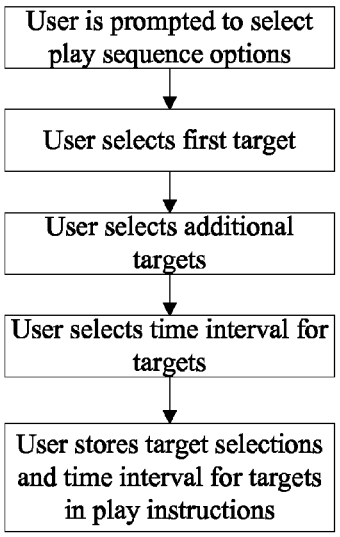
FIG. 14 is a stepwise flow diagram describing the process for programming multiple targets to illuminate simultaneously.
Figure 15:
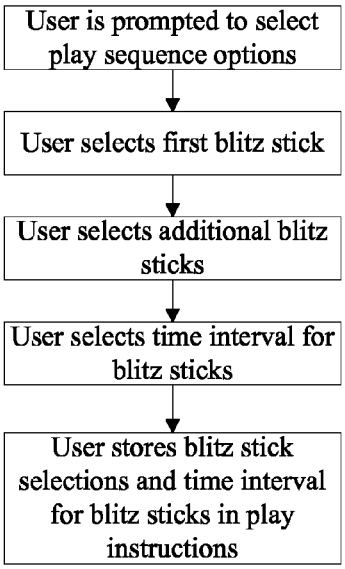
FIG. 15 is a stepwise flow diagram describing the process for programming multiple blitz sticks to illuminate simultaneously.

Referring to FIGS. 14-15, in order to select more than one target or blitz stick to light up simultaneously, the user selects each target or blitz stick individually. When all desired targets 2 and blitz sticks 3 have been selected, the user selects a time interval for the set of targets 2 or blitz sticks 3 and then presses the set button 1513 to store the target selections, blitz stick selections and time interval selection in the set of play instructions.

Figure 12:
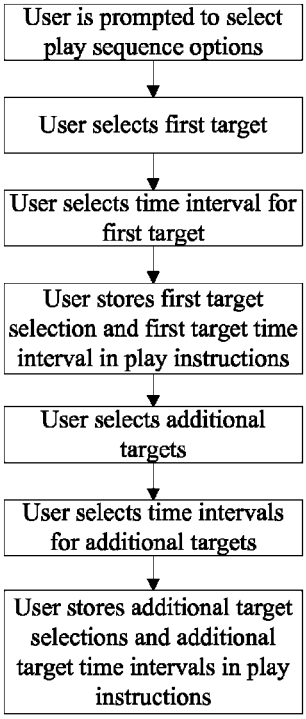
FIG. 12 is a stepwise flow diagram describing the process for programming multiple targets to illuminate in sequence.
Figure 13:
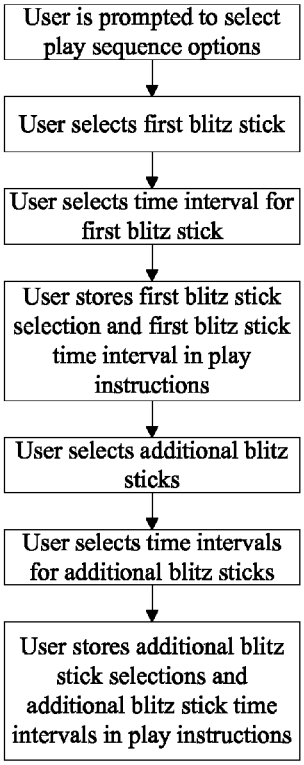
FIG. 13 is a stepwise flow diagram describing the process for programming multiple blitz sticks to illuminate in sequence.

Referring to FIGS. 12-13, in order to have more than one target or blitz stick light up in sequence, the user selects each target or blitz stick individually and then presses the set button 1513 after each selection to sequentially store each selected target or blitz stick in the set of play instructions. To program the time intervals between targets 2 or blitz sticks 3 lighting up, the user also selects a time interval for each target or blitz sticks 3 before pressing the set button 1513 to move on to programming an additional target or blitz stick. In an alternate embodiment of the present invention, the user may have the option to select targets 2 to light up at random or in a pattern undisclosed to the user. In alternate embodiments of the present invention, the graphical user interface provides different methods for selecting play options to create a play sequence. In the preferred embodiment of the present invention, the process of selecting play options may continue until the user removes the football from the football holder 14, initiating the play sequence.

In the preferred embodiment of the present invention, there is a delay between when the user removes the football from the football holder 14 and when the targets 2 and/or blitz sticks 3 light up. In one embodiment of the present invention, the user may have the option to change the duration of the delay between the removal of the football and the illumination of the target(s) and/or blitz stick(s) utilizing two buttons, one to increase the duration of the delay and one to decrease the duration of the delay. In the preferred embodiment of the present invention, the user also has the option to change the duration of the total time from the removal of the football from the football holder 14 to when all the targets 2 illuminate red and the speaker 17 sounds an alarm should the user not complete a pass before the timer countdown expires. In the case of multiple targets 2 or blitz sticks 3 illuminating in sequence, the user also has the option to modify the time intervals between the illuminations of each target or blitz stick. To do so, the user is provided with options to modify a time interval in addition to the options for selection of the targets 2 and blitz sticks 3. For each target or blitz stick, the user modifies a time interval before the user presses the set button 1513 to add the target or blitz stick to the sequence.

After the instructions for a play sequence have been programmed through the graphical user interface, the next step in the process is to activate the play sequence. The play sequence is activated when the user removes the football from the football holder 14, causing the football holder sensor 141 to send an activation signal to the deck chipset.

Upon receipt of the activation signal, the deck chipset 12 begins a timer countdown. The timer countdown defines the entire time interval of the play sequence. The timer countdown starts when the user removes the football from the football holder 14 and ends either when the deck chipset 12 receives a successful pass signal or when the timer countdown reaches zero without a successful pass signal being received. Termination of the timer countdown correlates with termination of the current play sequence. The snap deck 1 chipset communicates with the target chipsets 24 and blitz stick chipsets 33 through their respective radio communication devices, sending instructions to one or more targets 2 to illuminate a set of lights according to the currently programmed play sequence and may instruct zero, one or more blitz sticks 3 to illuminate, depending on the currently programmed play sequence based on the stored play instructions.

The user attempts to throw the football to an appropriate target within the time limit. In the preferred embodiment of the present invention, the default time duration of each play is the same, but the user has the option to change the duration of the play before the play is begun. The target is equipped with a plurality of sensors that facilitate signaling the snap deck to stop the countdown once the pass is completed and register the completed pass. If the ball contacts the appropriate target, the user has "completed the pass," the pass detection sensors 29 send a signal to the deck chipset through the target and deck radio communication devices, and the pass attempts counter 164 is increased by one. Additionally, upon receipt of a successful pass signal, the snap deck 1 chipset increases the current score by a specified amount. If the user completes a pass to the wrong target, the pass is registered as incomplete. In alternate embodiments of the present invention, completing a pass to the wrong target results in a deduction of points.

With each new play sequence, the pass attempts counter 163 is automatically increased by one. If an illuminated target does not receive a completed pass before the timer countdown expires, all targets 2 illuminate red, an audible alarm sounds, an incomplete pass is registered and the pass attempts display changes to reflect updated training session statistics. If a blitz stick is to be utilized in the program, the blitz stick either lights up immediately or a short time after the play is begun. A flashing red blitz stick indicates a blitz, while a steady red blitz stick indicates a pass rush. The user sees the blitz stick and acts accordingly as if he were in a real game scenario, avoiding the hypothetical pass rush or blitz and still attempting to make a complete pass to the appropriate illuminated target.

Although the present invention has been explained in relation to its preferred embodiment, it is to be understood that many other possible modifications and variations can be made without departing from the spirit and scope of the present invention as hereinafter claimed.

What is claimed is:

1. A football quarterback training apparatus comprising, a snap deck;

a plurality of targets;

a plurality of blitz sticks;

the snap deck comprises a deck radio communication device, a deck chipset, a housing, a football holder, a control panel, a speaker, an on/off switch, a deck power source, an adjustable height deck leg, a plurality of data storage ports, and a deck base;

each of the plurality of targets comprises a target frame, a net, a target radio communication device, a target chipset, a plurality of target lights, a target power source, an adjustable height target leg, a target base, and a plurality of pass detection sensors; and each of the plurality of the blitz sticks comprises a stick body, a stick radio communication device, a stick chipset, a plurality of stick lights, an adjustable height stick leg, a stick power source, and a stick base.

2. The football quarterback training apparatus as claimed in claim 1, wherein the snap deck being communicatively coupled by the snap deck radio communication device to each of the plurality of targets by the target radio communication devices;

the snap deck being communicatively coupled by the snap deck radio communication device to each of the plurality of blitz sticks by the stick radio communication device;

the snap deck being communicatively coupled by the snap deck radio communication device to each of the plurality of blitz sticks by the stick radio communication device;

the plurality of targets being positioned around the snap deck; and the plurality of blitz sticks being positioned around the snap deck between the snap deck and the plurality of targets.

3. The football quarterback training apparatus as claimed in claim 1, wherein the housing including a front lateral side;

the plurality of data storage ports including a universal serial bus port and a flash memory card slot;

the control panel being positioned atop the housing;

the deck chipset being positioned within the housing;

the deck base comprises a heavy stabilization material;

the adjustable height deck leg being connected adjacent to the housing opposite the control panel;

the on/off switch being positioned adjacent the housing; and the deck base being connected adjacent to the adjustable height deck leg and opposite the housing.

4. The football quarterback training apparatus as claimed in claim 3 comprises, the football holder being positioned adjacent to the front lateral side; and the control panel comprises a plurality of buttons and a plurality of displays.

5. The football quarterback training apparatus as claimed in claim 1, wherein the football holder including a holder sensor;

the holder sensor being centrally positioned on the football holder;

the deck power source being electrically connected to the deck radio communication device, the deck chipset, the control panel, the holder sensor, and the on/off switch; and the deck chipset being electronically connected to the deck radio communication device, the control panel, the holder sensor, the plurality of data storage ports and the on/off switch.

6. The football quarterback training apparatus as claimed in claim 4, wherein the plurality of numerical displays including a timer display, a point counter, a pass attempts counter, and a pass completions counter; and the plurality of buttons comprises a plurality of target programming buttons, a plurality of blitz stick programming buttons, a set button, and a plurality of timer adjustment buttons.

7. The football quarterback training apparatus as claimed in claim 1, wherein the plurality of target lights including a first colored light and a second colored light;

the net being perimetrically connected to the target frame;

the target frame being connected adjacent to the adjustable height target leg;

the target base being connected adjacent to the adjustable height target leg and opposite the target frame;

the plurality of target lights being positioned within the target frame;

the target frame being made of a first translucent material; and the target chipset, target radio communication device and target power source being positioned within the target frame.

8. The football quarterback training apparatus as claimed in claim 1, wherein the target chipset being electronically connected to the target radio communication device, the plurality of pass detection sensors, and the plurality of target lights;

the target power source being electrically connected to the target chipset, the target radio communication device, the plurality of pass detection sensors, and the plurality of target lights;

the plurality of pass detection sensors being of the infrared interrupter variety;

the plurality of pass detection sensors being positioned within the target frame, wherein the plurality of pass detection sensors operate by detecting an interruption in a beam of infrared light; and the plurality of pass detection sensors being positioned opposite each other.

9. The football quarterback training apparatus as claimed in claim 1, wherein the stick body being attached adjacent to the adjustable height stick leg;

the stick base being connected adjacent to the adjustable height stick leg and opposite the stick body;

the plurality of stick lights being positioned within the stick body;

the stick body being made of a second translucent material; and the stick chipset, stick radio communication device and stick power source being positioned within the stick frame.

10. The football quarterback training apparatus as claimed in claim 1, wherein the stick chipset being electronically connected to the stick radio communication device and the plurality of stick lights; and the stick power source being electrically connected to the stick chipset, the plurality of stick lights, and the stick radio communication device.

* * * * *